United States Patent [19]

Walker

[11] 4,212,434

[45] Jul. 15, 1980

[54] THEFT DETERRENT TOILET ROLL SPINDLES

[75] Inventor: Randall B. Walker, S. San Francisco, Calif.

[73] Assignee: The Bobrick Corporation, North Hollywood, Calif.

[21] Appl. No.: 970,340

[22] Filed: Dec. 18, 1978

[51] Int. Cl.[2] ..... B65H 19/00

[52] U.S. Cl. ..... 242/55.2

[58] Field of Search ..... 242/55.2, 55.3, 55.42, 242/55.53, 55.54, 55.55

[56] References Cited

U.S. PATENT DOCUMENTS

| | | | |
|---|---|---|---|
| 464,201 | 12/1891 | Rowland | 242/55.2 |
| 710,034 | 9/1902 | Belknap | 242/55.2 |
| 2,858,994 | 11/1958 | Sarro | 242/55.2 |

FOREIGN PATENT DOCUMENTS

| | | | |
|---|---|---|---|
| 10521 | 12/1932 | Australia | 242/55.2 |
| 247461 | 2/1926 | United Kingdom | 242/55.2 |

*Primary Examiner*—Edward J. McCarthy

[57] ABSTRACT

A theft deterrent toilet tissue spindle, the spindle having an axially movable stem received in a conventional holder for movement between a spindle retaining and a spindle releasing position; the spindle having an access slot for receiving a tool engageable with the stem to release the spindle; the access slot being concealed by the cardboard core of the toilet tissue roll and requiring tearing of such core from the spindle in order to remove the spindle from its holder.

1 Claim, 4 Drawing Figures

THEFT DETERRENT TOILET ROLL SPINDLES

BACKGROUND AND SUMMARY

Theft and vandalism of a toilet tissue roll as well as their supporting spindles pose a substantial problem. Spindles have been made which remain inaccessible after the spindle and toilet tissue roll have been installed on their holder, however as the roll is depleated leaving the cardboard core and a few wrappings of tissue the spindle may be manipulated readily by hand.

The present invention is directed to a toilet roll spindle which minimizes theft of the spindle under such conditions; more particularly, the spindle is provided with an axially movable stem received in the spindle and externally accessible through a slot in the spindle to release the spindle; however, the slot remains concealed by the core of the toilet tissue roll thereby minimizing the chance that the manner of removal will be ascertained.

DETAILED DESCRIPTION

Figure 1:
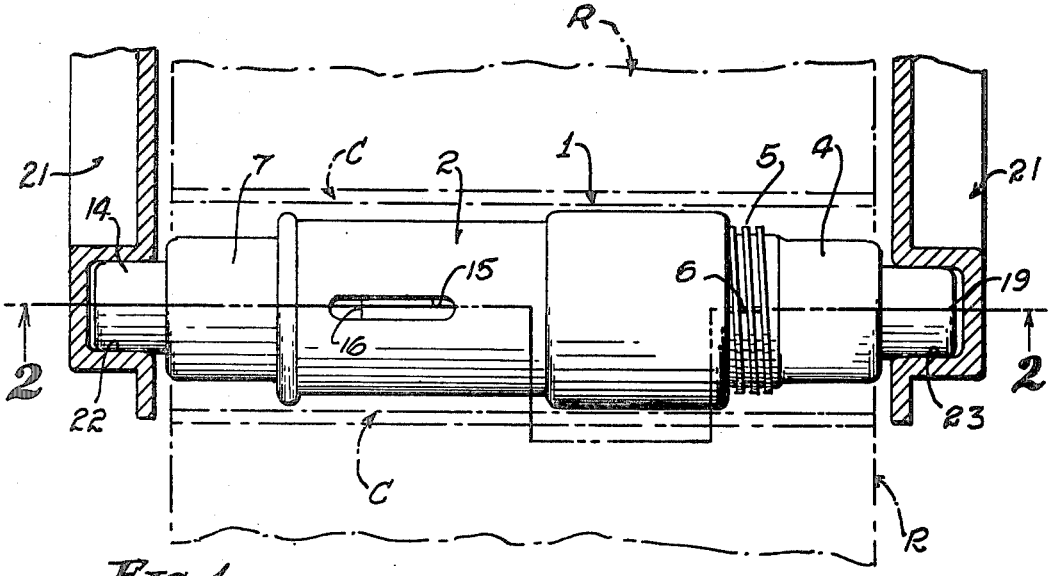
FIG. 1 is a side view of the theft deterrent for toilet roll spindles shown in position on a conventional holder and illustrating by broken lines a roll of toilet tissue and its cardboard core.
Figure 2:
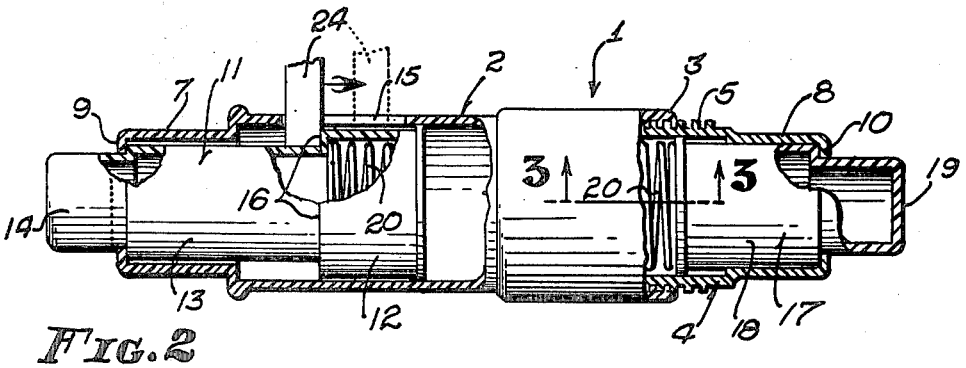
FIG. 2 is a similar partial side view, partial sectional view thereof, the sectional view being taken through 2—2 of FIG. 1.
Figure 3:
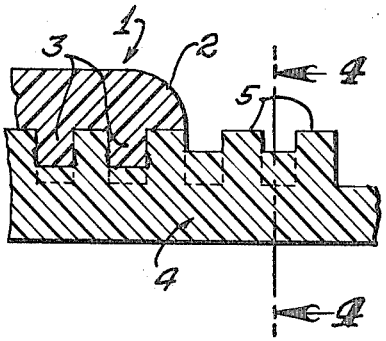
FIG. 3 is an enlarged fragmentary sectional view taken through 3—3 of FIG. 1.
Figure 4:
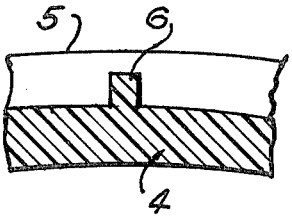
FIG. 4 is another enlarged fragmentary sectional view taken through 4—4 of FIG. 3.

The theft deterrent is incorporated in a spindle 1 which includes a tubular first sleeve 2 of proper dimension to be slidably received in the core C of a toilet tissue roll R. One end is internally screwthreaded as indicated by 3 in FIG. 3.

The sleeve 2 receives a second sleeve 4 which is externally screwthreaded as indicated by 5. The screwthreads 5 are provided with small ribs 6 forming an interference strip with the mating screwthreads 3. The remote portions of the sleeves 2 and 4 are reduced in diameter, as indicated by 7 and 8 respectively, and have corresponding internal flanges 9 and 10.

Received in the first sleeve 2 is a stem 11 having an inner portion 12 slidable in the main portion of the sleeve 2, and intermittent portion 13 slidable in the reduced portion 7, and a projecting portion 14 extending through the internal flange 9. The sleeve 2 has a longitudinal slot 15 exposing a shoulder 16 formed between the portions 12 and 13.

The second sleeve 4 is provided with a stem 17 having an inner portion 18 slidable in the second sleeve 4, and a projecting portion 19 forming with the inner portion 18 a shoulder engageable with the internal flange 10. A spring 20 is interposed between the stems 11 and 17 to urge the stems outwardly until limited by the internal flanges 9 and 10.

Operation of the theft deterrent is as follows:

A roll 12 of toilet tissue is installed in the spindle 1 in an essentially conventional manner; that is, the spindle is inserted through the core C, one stem is inserted in a socket 22 while the other stem is depressed and inserted into the socket 23 of the holder. Once installed the spindle 1 is not accessible due to the roll of tissue R.

When the tissue has been entirely used or nearly so there is no indication that the spindle is removable as the tool slot 15 is covered by the core C. The attendant knowing the presence of the slot 15 and the shoulder 16, removes the core C and inserts an appropriate tool such as a screwdriver or other projection dimensioned to engage the shoulder 16 and retract the stem and remove the spindle.

The screwthreads 3 and 5 provide axial adjustment to accommodate different widths of tissue rolls. The interference strip provided by the small webs 6 enable the adjustment to remain fixed.

Having fully described my invention, it is to be understood that I am not to be limited to the details herein set forth, but that my invention is of the full scope of the appended claims.

I claim:

1. A theft minimizing toilet roll spindle for dispensing toilet tissue rolled about a distructable core and utilizing a holder having a pair of opposed journal sockets, the spindle comprising:

a. a thin walled sleeve slidable received in the core contiguous to the internal surface thereof, the sleeve having an axially extending slot confronting the core;

b. a pair of thin walled tubular stems received in opposite ends of the sleeve having end portions of reduced diameter dimensioned to be slidably received in the journal sockets;

c. at least one of the tubular stems having an external shoulder exposed to the slot for engagement by a hand tool upon removal of the core;

d. both of the stems having internal shoulders;

e. and a spring interposed between the shoulders to urge the reduced ends of the stems into the journal sockets.

* * * * *